US008668081B2

(12) United States Patent
Hippely et al.

(10) Patent No.: US 8,668,081 B2
(45) Date of Patent: Mar. 11, 2014

(54) TOY VEHICLE STORAGE CASE WITH RACE TRACK

(75) Inventors: Keith Hippely, Manhattan Beach, CA (US); Michael Lee, Valencia, CA (US)

(73) Assignee: Mattel, Inc., El Segundo, CA (US)

( * ) Notice: Subject to any disclaimer, the term of this patent is extended or adjusted under 35 U.S.C. 154(b) by 25 days.

(21) Appl. No.: 13/294,904

(22) Filed: Nov. 11, 2011

(65) Prior Publication Data

US 2012/0118765 A1 May 17, 2012

Related U.S. Application Data

(60) Provisional application No. 61/413,301, filed on Nov. 12, 2010.

(51) Int. Cl.
*B65D 69/00* (2006.01)
*B65D 77/00* (2006.01)

(52) U.S. Cl.
USPC ..... 206/223; 206/579; 206/216

(58) Field of Classification Search
CPC ..... B65D 85/00; A63H 18/00; A63H 18/08; A63H 18/14; A63H 18/028; A63H 18/04; A63H 18/02; A63H 17/008
USPC ..... 446/76, 75, 73, 72, 71, 444, 445, 429; 206/223, 216, 335, 579
See application file for complete search history.

(56) References Cited

U.S. PATENT DOCUMENTS

| | | | | | |
|---|---|---|---|---|---|
| 1,914,116 | A | | 6/1933 | Ford | |
| 1,961,957 | A | * | 6/1934 | Bock | 446/75 |
| 2,198,306 | A | | 4/1940 | Fisher | |
| 2,616,630 | A | | 11/1952 | De Michele | |
| 2,618,437 | A | * | 11/1952 | Matthaeis, Jr. | 238/10 A |
| 2,992,598 | A | | 7/1961 | Einfalt | |
| 3,108,398 | A | | 10/1963 | Einfalt | |
| 3,658,333 | A | * | 4/1972 | Carcel | 463/69 |
| 3,998,460 | A | * | 12/1976 | Dyer | 463/64 |
| 4,077,628 | A | | 3/1978 | Hebert | |
| 4,192,093 | A | | 3/1980 | Hamano | |
| 4,285,157 | A | * | 8/1981 | Lambert | 446/76 |
| 4,349,983 | A | | 9/1982 | Kilroy et al. | |
| 4,365,438 | A | | 12/1982 | Nelson | |
| 4,382,347 | A | | 5/1983 | Murakami | |
| 4,433,504 | A | | 2/1984 | Terui | |
| 4,472,008 | A | | 9/1984 | Pearlstein | |
| 4,505,686 | A | | 3/1985 | Mariol | |
| 4,516,948 | A | | 5/1985 | Obara | |
| 4,558,867 | A | | 12/1985 | Hippely | |
| 4,669,657 | A | | 6/1987 | Crain et al. | |
| 4,708,683 | A | * | 11/1987 | Lehmann et al. | 446/75 |
| 4,898,404 | A | | 2/1990 | Babcock | |
| 4,937,207 | A | | 6/1990 | Simmell et al. | |
| 4,946,413 | A | | 8/1990 | Lehmann et al. | |

(Continued)

FOREIGN PATENT DOCUMENTS

| | | |
|---|---|---|
| GB | 2135591 | 9/1984 |
| GB | 2159721 | 12/1985 |
| WO | 2007056483 | 5/2007 |

*Primary Examiner* — J. Gregory Pickett
*Assistant Examiner* — Kaushikkumar Desai
(74) *Attorney, Agent, or Firm* — Kolisch Hartwell, PC

(57) ABSTRACT

A toy vehicle storage case may be placed in a racing configuration with a toy vehicle raceway deployed and supported by the storage case, or a transport configuration with the storage case containing the toy vehicle raceway.

31 Claims, 8 Drawing Sheets

(56) References Cited

U.S. PATENT DOCUMENTS

| | | | | |
|---|---|---|---|---|
| D393,495 | S | 4/1998 | Blumenthal | |
| 5,813,351 | A | 9/1998 | Chen | |
| 5,839,937 | A | 11/1998 | Thomas | |
| 5,931,099 | A | 8/1999 | Bruner et al. | |
| 5,961,149 | A | 10/1999 | Hunt | |
| 6,099,380 | A | 8/2000 | Rasmussen | |
| D432,302 | S * | 10/2000 | Chen | D3/271.12 |
| 6,325,692 | B1 | 12/2001 | Webb | |
| 6,358,112 | B1 | 3/2002 | Lambert et al. | |
| 6,554,685 | B2 | 4/2003 | Lish | |
| 6,572,436 | B1 | 6/2003 | So | |
| 6,647,893 | B1 * | 11/2003 | Fugitt et al. | 104/69 |
| D489,776 | S | 5/2004 | Hoeting et al. | |
| 6,783,419 | B1 | 8/2004 | Paukert et al. | |
| 6,913,508 | B2 | 7/2005 | Hornsby et al. | |
| 7,018,267 | B2 | 3/2006 | Delaney et al. | |
| 7,241,223 | B1 * | 7/2007 | Caudill | 463/62 |
| D554,202 | S | 10/2007 | Knight et al. | |
| D554,203 | S | 10/2007 | Knight et al. | |
| 7,285,034 | B2 | 10/2007 | Kay et al. | |
| D555,210 | S | 11/2007 | Knight et al. | |
| D555,211 | S | 11/2007 | Knight et al. | |
| D555,212 | S | 11/2007 | Knight et al. | |
| 7,594,844 | B2 | 9/2009 | Cartlidge et al. | |
| 7,618,301 | B2 | 11/2009 | Knight et al. | |
| 7,618,302 | B2 | 11/2009 | Collins et al. | |
| 7,628,674 | B2 | 12/2009 | Nuttall et al. | |
| 7,651,398 | B2 | 1/2010 | Ostendorff et al. | |
| 7,753,753 | B2 | 7/2010 | Payne et al. | |
| 7,770,811 | B2 | 8/2010 | Belding | |
| 2006/0021905 | A1 | 2/2006 | Johnson | |
| 2008/0014832 | A1 * | 1/2008 | Ostendorff et al. | 446/444 |

* cited by examiner

TOY VEHICLE STORAGE CASE WITH RACE TRACK

CROSS-REFERENCE TO RELATED APPLICATIONS

This application claims priority under 35 U.S.C. §119 to U.S. Provisional Patent Application Ser. No. 61/413,301, filed Nov. 12, 2010 and entitled TOY VEHICLE STORAGE CASE WITH RACE TRACK, the complete disclosure of which is incorporated herein by reference for all purposes.

FIELD OF THE DISCLOSURE

This disclosure relates generally to toy vehicles and more particularly to storage, transport, and racing of toy vehicles.

BACKGROUND

People of all ages enjoy playing with toy vehicles. MATCHBOX® and HOT WHEELS® toy vehicles, for example, have been enjoyed by children and collectors alike since the mid 20$^{th}$ century. As people accumulate multiple toy vehicles, they require convenient storage for their collection. Additionally, one of the ways in which toy vehicles may be enjoyed is through the activity of racing multiple cars on a suitable race track. The present disclosure combines these and other useful features into one apparatus.

Toy vehicles may be enjoyed with accessories including play structures incorporating tracks, roadways, and other structures configured for toy vehicle play. Examples of play structures with tracks for toy vehicles are disclosed in U.S. Pat. Nos. 7,651,398, 6,913,508, 6,647,893, 6,358,112, 6,099,380, 4,349,983, 4,946,413, and 4,077,628. The disclosures of these and all other publications referenced herein are incorporated by reference in their entirety for all purposes.

SUMMARY

Toy vehicle storage cases according to the present disclosure may include an upper section and a lower section, which may be hinged together, and configured such that the case itself has the general appearance of a vehicle. The case may include a plurality of storage compartments for toy vehicles in the lower section and may include one or more storage compartments in the upper section. The case may be configured to contain a toy vehicle raceway, which may include a plurality of track segments. The raceway may also include a starting gate, which may be configured to retain toy vehicles in a starting position and further configured to release the toy vehicles to roll down the plurality of tracks. The starting gate may be further configured to act as a latching mechanism. The case may include a carrying handle which may be configured to provide stability to the apparatus, for example when the raceway is in a deployed position.

The toy vehicle raceway according to the present disclosure may be configured to be collapsed or folded into a storage position, and contained within the case for easy transportation.

The raceway may include three or more track segments. The three track segments may be hinged together to allow for folding of the raceway into a storage position. The upper and lower sections of the case may be configured to provide support and positioning for the raceway when it is deployed. In the deployed position, the track portions may be configured at an angle such that a general downward slope is achieved from a starting end to a finishing end, with a final track portion having a terminal end resting against a support surface such as a table or floor. When in this deployed position, the carrying handle may be configured to provide propping, support, and/or stability to the apparatus.

Advantages of the present disclosure will be more readily understood after considering the drawings and the Detailed Description.

DETAILED DESCRIPTION OF THE DISCLOSURE

Figure 1:
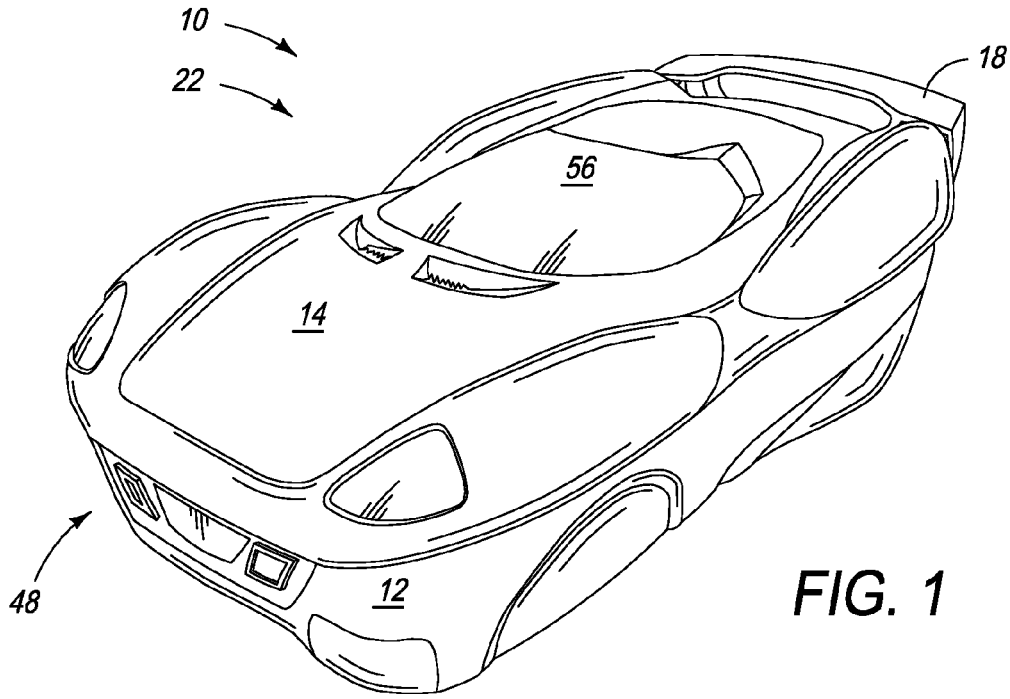
FIG. 1 is a front perspective view of an illustrative toy vehicle storage case.
Figure 2:
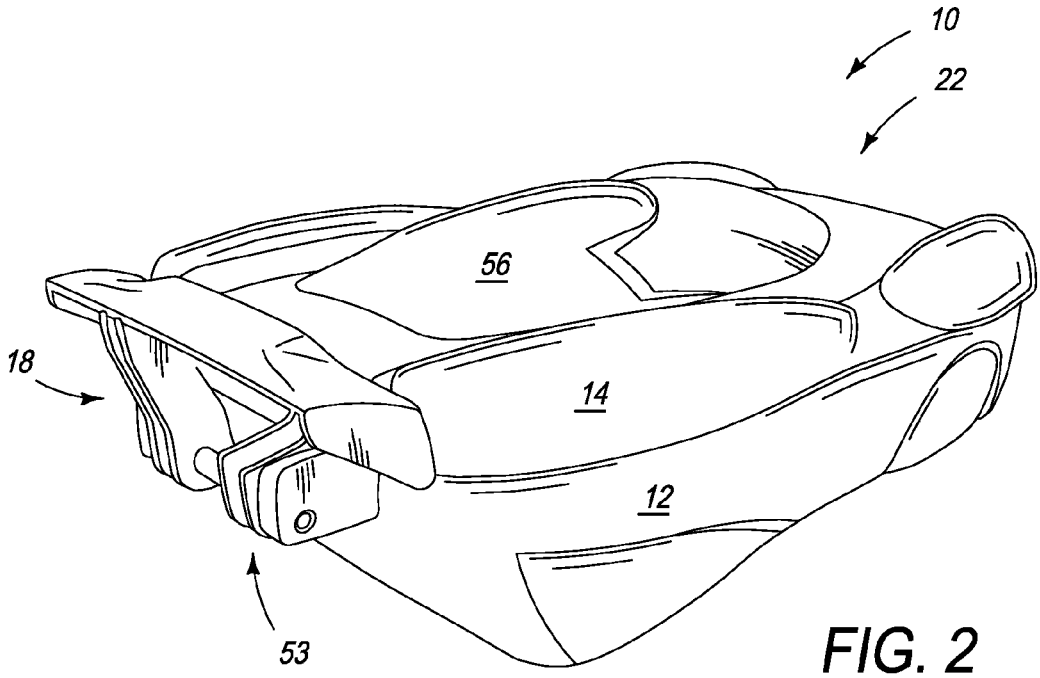
FIG. 2 is a rear perspective view of an illustrative toy vehicle storage case.
Figure 3:
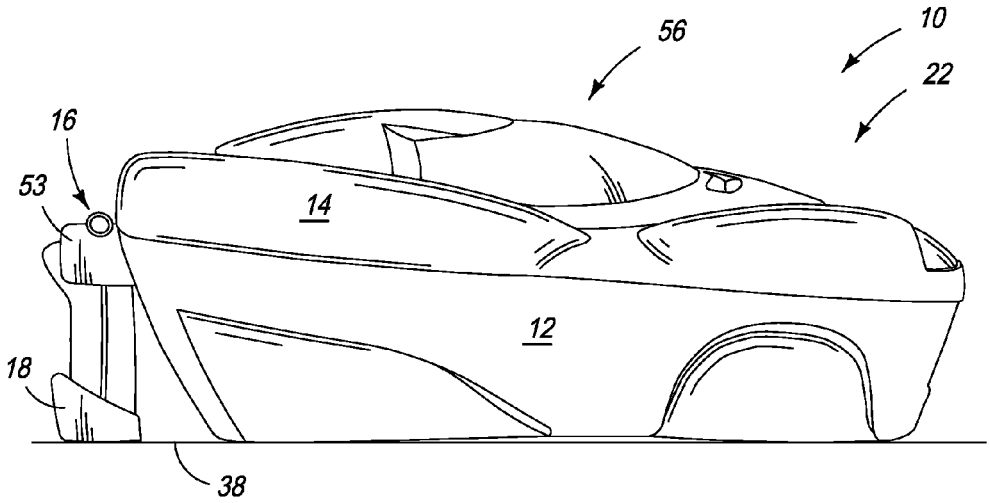
FIG. 3 is a side view of an illustrative toy vehicle storage case.

An example of a toy vehicle storage case 10 is shown generally in FIGS. 1 through 6. Unless otherwise specified, toy vehicle storage case 10 may, but is not required to, contain at least one of the structure, components, functionality, and/or variations described, illustrated, and/or incorporated herein. Toy vehicle storage case 10 may include a base or lower container portion 12, a lid or upper container portion 14, a hinge 16, a handle 18, and/or a toy vehicle raceway 20. Toy vehicle storage case 10 may be configured to have the appearance of a vehicle. For example, toy vehicle storage case 10 may have the appearance of a toy race car as shown in FIGS. 1-3. Toy vehicle storage case 10 may also be capable of a plurality of configurations. For example, toy vehicle storage case 10 may be arranged in a transport configuration 22 and may be arranged in a racing configuration 24.

Figure 4:
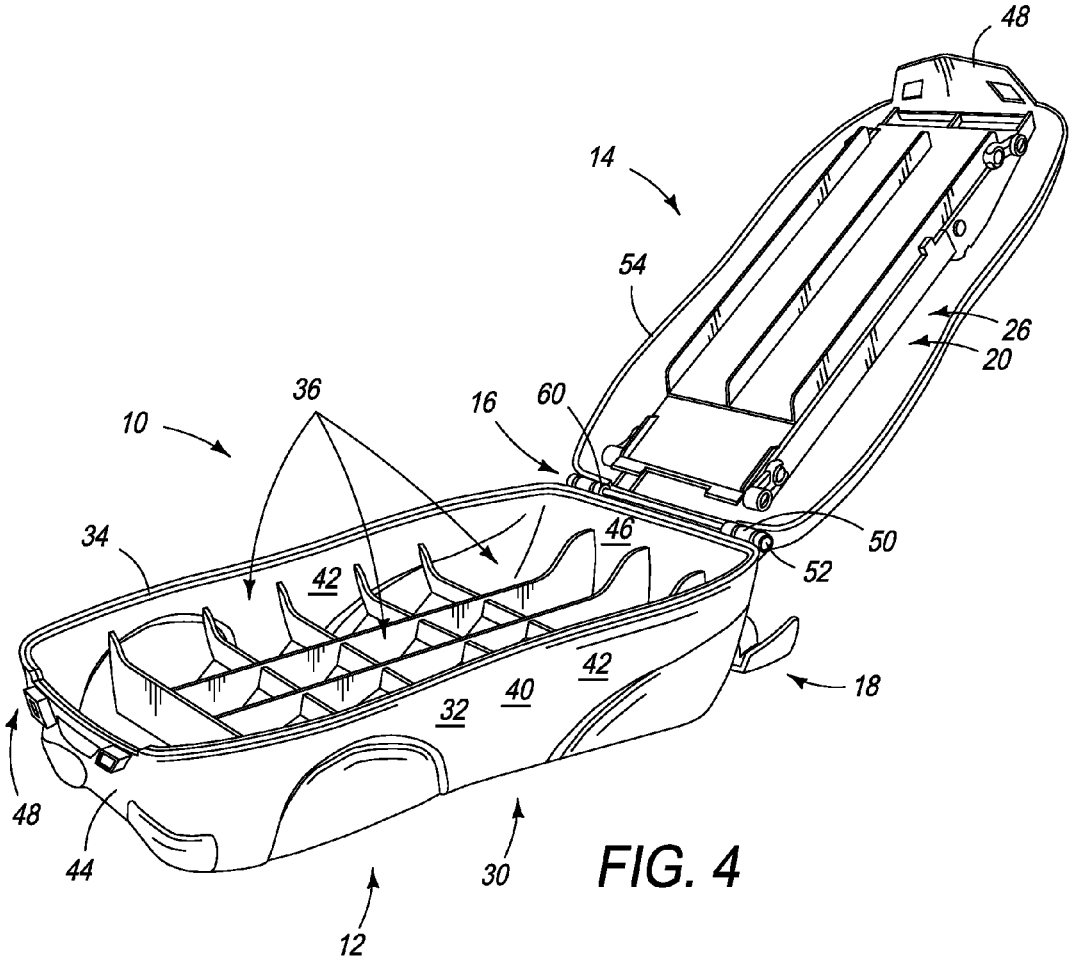
FIG. 4 is a perspective view of an illustrative toy vehicle storage case with the upper section opened.
Figure 5:
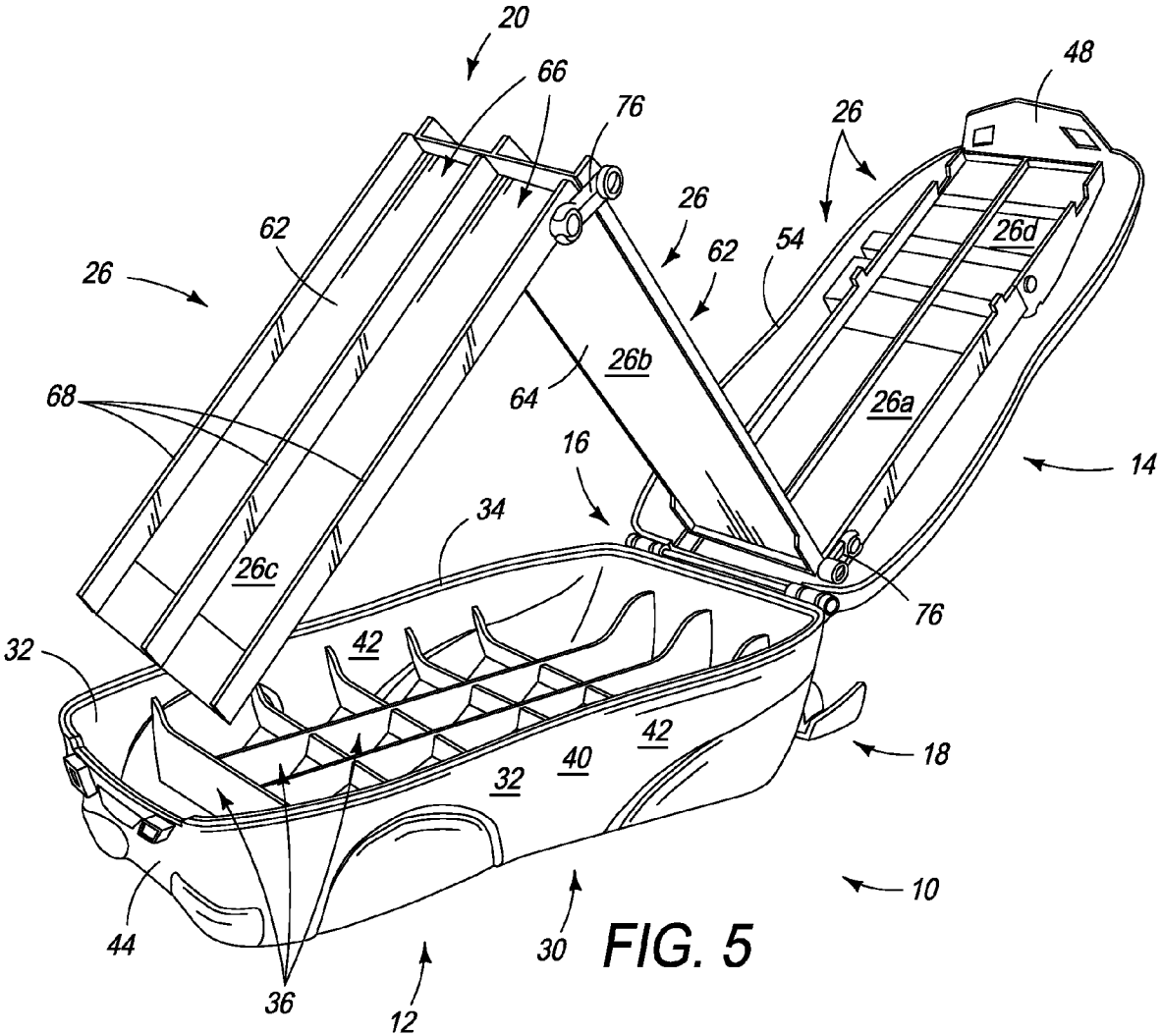
FIG. 5 is a perspective view of an illustrative toy vehicle storage case with a toy vehicle raceway partially deployed.
Figure 6:
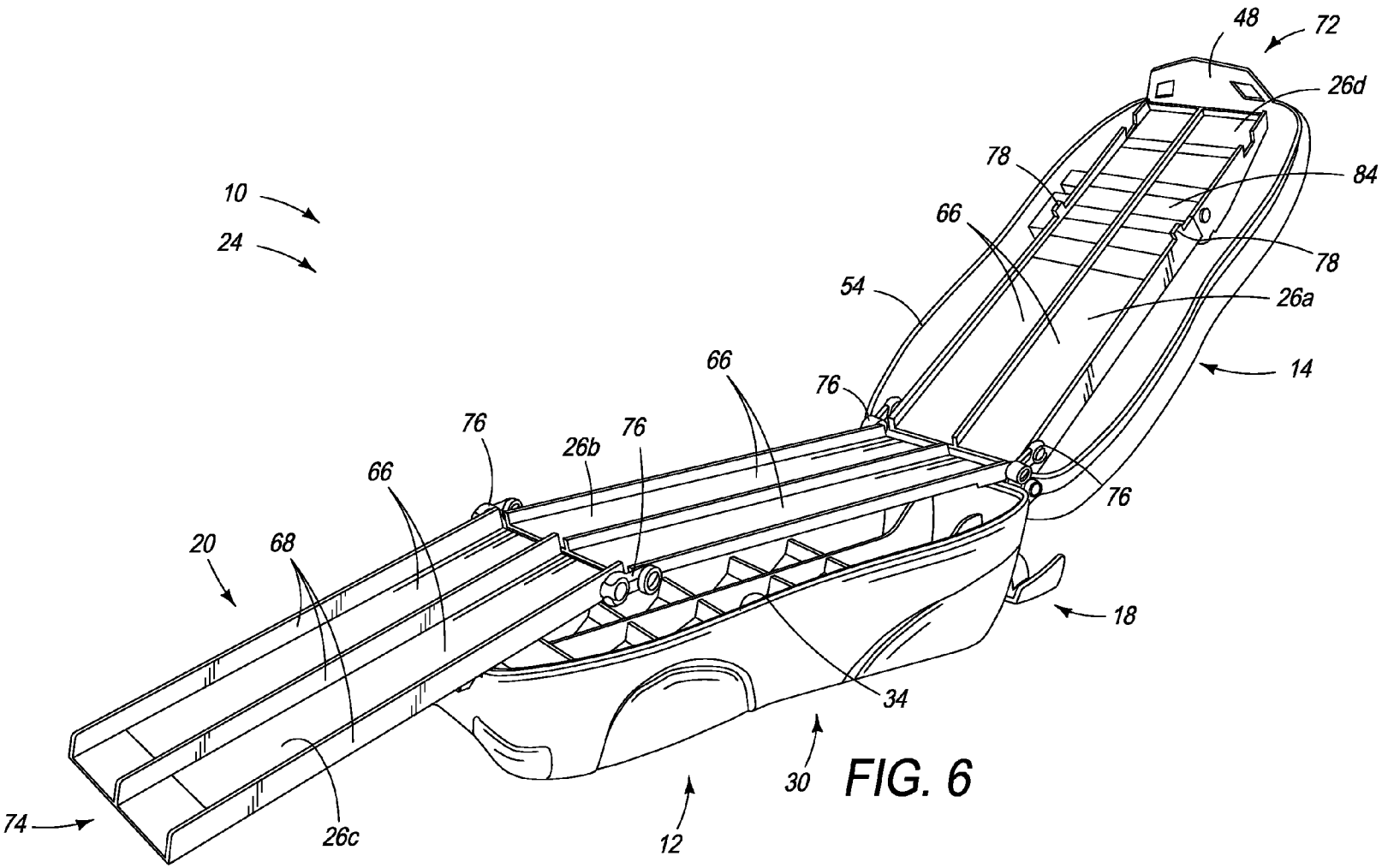
FIG. 6 is a perspective view of an illustrative toy vehicle storage case with a toy vehicle raceway fully deployed.

FIG. 4 shows an illustrative toy vehicle storage case 10 opened to show an interior with toy vehicle raceway 20 collapsed and disposed on upper container portion 14. Toy vehicle raceway 20 may include any suitable structure configured as a collapsible raceway for toy vehicles, and may include a plurality of track segments 26. FIG. 5 shows the toy vehicle storage case of FIG. 4 with raceway 20 in the process of being deployed. FIG. 6 shows raceway 20 fully deployed, with toy vehicle storage case 10 in racing configuration 24.

Figure 7:
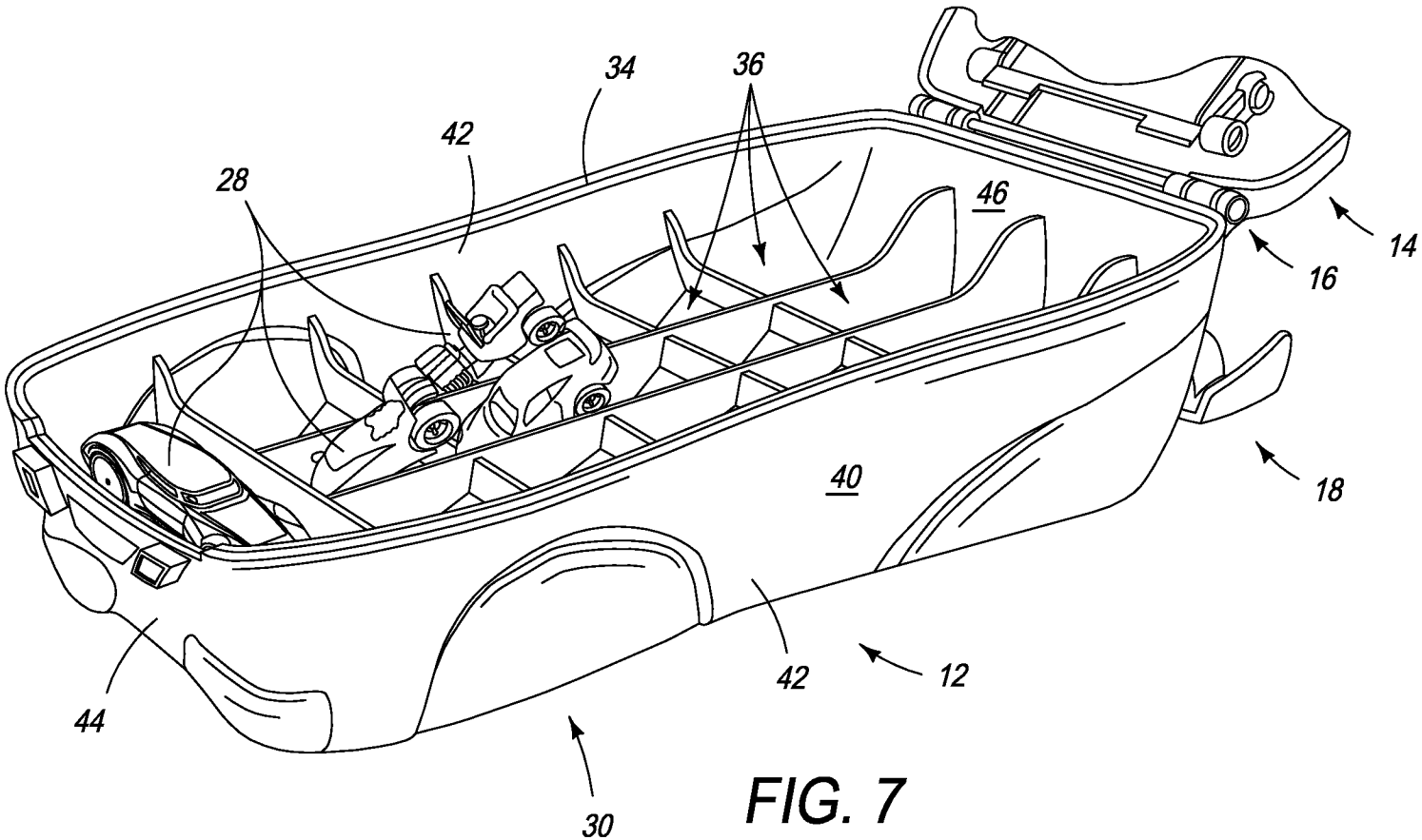
FIG. 7 shows a perspective view of examples of toy racing vehicles placed in a plurality of storage compartments in a lower portion of an illustrative toy vehicle storage case.

As best seen in FIGS. 4 and 7, lower container portion 12 may include any suitable rigid or semi-rigid structure configured to contain one or more toy vehicles 28. For example, lower container portion 12 may include a floor 30 and walls 32, which form a container that may be generally shaped in the contour and appearance of a lower section of a vehicle. Upper edges of walls 32 of lower container portion 12 may generally define a mouth of the lower container portion having a perimeter 34 generally defining a plane.

As shown in FIGS. 4 and 7, an interior of lower container portion 12 may be configured to contain a plurality of storage compartments 36 for toy vehicles. Each one of storage compartments 36 may be of any size suitable to partially enclose and restrain a toy vehicle while leaving the vehicle easily accessible for removal. For example, lower container portion 12 may contain a number of compartments 36 in a main storage area sized to contain a first size of toy vehicles 28 and one or more larger compartments 36 at one end sized to contain a larger toy vehicle 28.

Floor 30 may be an elongate, rigid or semi-rigid plate generally defining a plane and configured to support lower container portion 12 on a suitable support surface 38 such as a table. When lying flat, floor 30 may form the bottom of toy vehicle storage case 10, and may form the bottom of storage compartments 36 in lower container portion 12. Walls 32 and floor 30 collectively form lower container portion 12. Floor 30 may be made of any suitable rigid or semi-rigid material, such as ABS plastic.

Walls 32 may be any rigid or semi-rigid, substantially vertical plates connected to floor 30 and forming an open-topped container. Walls 32 may be configured in a continuous, elongate shape. For example, walls 32 may be configured in a stylized fashion such as the general shape and appearance of a lower part of a vehicle. An exterior 40 of walls 32 may be further contoured and decorated in any suitable fashion to give the appearance of a vehicle. Walls 32 may include two side walls 42, front wall 44, and rear wall 46. Front wall 44 may be configured to include any suitable structure that provides a latching surface configured to mate with a corresponding structure on upper container portion 14. For example, front wall 44 may include one portion of a friction fit latch 48 that fits under and mates with a corresponding portion of latch 48 on upper container portion 14. Additional types of latches may include sliding, button, snaps, hooks, hook and loop, derivatives thereof, and combinations thereof. Rear wall 46 may act as a mounting surface for hinge 16 and handle 18.

As shown in the example of FIG. 4, lower container portion 12 and upper container portion 14 may be hingedly attached to form a lidded container. Hinged attachment may be accomplished by any suitable pivoting structure. For example, hinge 16 may include one or more hinge knuckles 50 and one or more hinge pins 52. Hinge 16 may be attached to rear wall 46 by any suitable means. For example, hinge 16 may be fastened to rear wall 46. Alternatively, hinge 16 may be molded as one rigid or semi-rigid piece with rear wall 46. In one example, depicted in FIG. 4, one set of hinge knuckles 50 and hinge pins 52 is disposed at each of two opposite ends of rear wall 46 such that a gap is left between the two sets of hinge knuckles and pins. In other examples, a single set of hinge knuckles 50 and/or a single, longer hinge pin 52 may be used.

Handle 18 may include any suitable structure configured to function as both a carrying handle and a stability mechanism. For example, handle 18 may be rigid and hingedly attached to rear wall 46 of lower container portion 12. Handle 18 may include hinge 53. In some examples, handle 18 may be rigid and substantially rectangular or trapezoidal in shape, sized such that it may be suitable for carrying by hand and may be placed in one of at least two stable configurations when toy vehicle storage case 10 is lying flat as illustrated in FIGS. 1-3. In a first, upright position, illustrated in FIGS. 1 and 2, handle 18 may be vertically disposed with a portion of handle 18 disposed substantially in a plane with the top of upper container portion 14. Handle 18 may be configured to have the shape of a part of a vehicle suitable for display in this position. For example, handle 18 may configured to have an appearance of a vehicle spoiler. In a second, downward position, handle 18 may be vertically disposed with a portion disposed substantially in the plane of floor 30 of lower container portion 12, as shown in FIG. 3. In the downward position, handle 18 may be configured to provide stability to toy vehicle case 10 by effectively extending an overall length of lower container portion 12. For example, handle 18 may provide stability to storage case 10 when raceway 20 is in racing configuration 24. In some examples, handle 18 may act as a weight-bearing member, resting on support surface 38.

In other examples, not pictured, handle 18 may be any suitable structure configured to prop upper container portion 14 in an open position, such as when storage case 10 is in racing configuration 24. For example, handle 18 may be configured to mate with a corresponding notch or other structure on upper container portion 14 to selectively lock upper container portion 14 at a predetermined angle.

Hinge 53 may include any suitable structure configured to pivotably attach handle 18 to rear wall 46. For example, hinge 53 may include hinge knuckles and one or more hinge pins fastened or molded as part of rear wall 46. In some examples, handle 18 may be attached to upper container portion 14 or some other part of lower container portion 12.

Upper container portion 14 may include any suitable structure configured to provide a latchable, hinged lid for lower container portion 12 and may be further contoured and decorated to present the appearance of a vehicle. Upper container portion 14 may be a rigid or semi-rigid, substantially concave structure configured to mate in a friction fit with lower container portion 12.

Lower edges of upper container portion 14 may generally form a mouth of the upper container portion having a perimeter 54 generally defining a plane. Upper container portion 14 may be further configured to hold a portion of raceway 20 at a predetermined angle when in racing configuration 24 as shown in FIG. 6, and to contain raceway 20 in collapsed or transport configuration 22 as shown in FIGS. 1-3. For example, upper container portion 14 may be configured to open to an obtuse angle relative to lower container portion 12, and may be held in that position by stops or other parts of the two container portions coming into contact with each other.

Raceway 20 may be disposed adjacent to upper container portion 14 when in transport configuration, as depicted in FIG. 4. To maintain an overall vehicular appearance of toy vehicle storage case 10, upper container portion may be configured, contoured, and/or decorated to resemble a vehicle. For example, upper container portion 14 may have the appearance of an upper surface of a toy race car.

A cavity created by the concave shape of upper container portion 14 may allow storage of one or more toy vehicles 28 between upper container portion 14 and raceway 20. In some examples, as shown in FIGS. 1-3, upper container portion 14 may include at least one canopy 56 and storage space 58. Canopy 56 may be formed as a part of the overall structure and appearance of upper container portion 14. For example, canopy 56 may be shaped and contoured to appear as a driving compartment, windshield, or other subcomponent of a vehicle, such as a door, window, trunk, or hood.

Storage space 58 may be disposed between canopy 56 and raceway 20. In some examples, not pictured, storage space may instead by formed by providing a canopy floor under canopy 56. In some examples, including those with a canopy floor, canopy 56 may include hinge and latch structures, such that canopy 56 may be selectively opened to uncover storage space 58. In other examples, shown in FIGS. 8A-8C, a portion of raceway 20 may be configured to pivot away from upper container portion 14 to allow access to storage space 58.

Latch 48 may include any suitable structure formed as part of or attached to upper container portion 14 and configured to interface with a corresponding structure on front wall 44 to hold upper container portion 14 closed with respect to lower container portion 12. For example, latch 48 may be a friction fit latch with a tab or flap portion disposed at the front of upper container portion 14 such that the front of upper container portion 14 fits over front wall 44 and reversibly holds the container portions together, as shown in FIG. 1.

Hinge 16 may connect upper container portion 14 to lower container portion 12. Upper container portion 14 may include upper hinge knuckles 60 configured to connect with one or more hinge pins 52. Upper hinge knuckles may be attached to upper container portion 14 by any suitable method. For example, upper hinge knuckles may be formed as part of upper container portion 14 or fastened to upper container portion 14.

It may be seen from the above description that in some examples toy vehicle storage case includes perimeter 54 generally defining a first plane, perimeter 34 generally defining a second plane, and floor 30 generally defining a third plane. In racing configuration 24, toy vehicle storage case 10 may be arranged with the first plane positioned at an obtuse angle relative to the second plane. In this configuration, raceway 20 may be held in a deployed position by virtue of being operatively connected to upper container portion 14, with a ramped angle of the deployed raceway being substantially determined by the position of the open upper and lower container portions of toy vehicle storage case 10.

In one example, a first track segment 26 is disposed on open upper container portion 14, a second track segment 26 is disposed on the substantially flat or slightly angled lower container portion 12, and a third track segment 26 angles down from the lower section such that a lower end of the third track segment is substantially coplanar with the third plane defined by floor 30 of lower container portion 12. For example, a third track segment 26 may rest on support surface 38. This arrangement may provide an overall downward angle to raceway 20 suitable for racing toy vehicles propelled by gravity or other means.

In other examples, a second track segment 26 is held at each end by attachments to a first and a third track segment 26, and the third track segment 26 is supported by a portion of lower container portion 12, such that the second track segment 26 is not touching lower container portion 12.

Raceway 20 may include a plurality of track segments 26 configured as multi-lane track segments such that raceway 20 is a multi-lane toy raceway. For example, raceway 20 may include four track segments indicated at reference numeral 26*a*, 26*b*, 26*c*, and 26*d* in FIGS. 4-6. As best seen in the example depicted in FIG. 5, track segments 26*a*, 26*b*, and 26*c* may each include a racing surface 62 and a non-racing surface 64. Racing surface 62 may include a plurality of parallel racing lanes 66.

In some examples, one or more of the plurality of lanes 66 may be configured to guide toy vehicles 28 along the raceway. As such, the plurality of racing lanes 66 may include at least one traveling surface along which a toy vehicle may travel and at least one guiding structure, which may at least partially maintain a toy vehicle along the at least one traveling surface. For example, as shown in FIG. 5, the plurality of track segments 26 may each include a plurality of parallel longitudinal ribs 68, which may be configured to define the plurality of spaced apart lanes 66.

The U-shaped profile of lanes 66 shown in the example presented in FIG. 5 may serve to guide a toy vehicle 28 as it travels along the lane, with a pair of ribs 68 serving as a guiding structure disposed at opposing edges of the lane. In other examples, a guiding structure may be in the form of a ridge running down the center of a lane, such as where toy vehicle 28 includes one or more pairs of wheels that straddle a central ridge (not pictured).

Along with toy vehicle storage case 10, raceway 20 may be configured to transition between transport configuration 22 and racing configuration 24. An example of racing configuration 24 of raceway 20 is shown in FIG. 6, where track segments 26 are aligned to provide a toy vehicle raceway having a track that extends from a first end 72 to a second end 74. An external view of an example of transport configuration 22 of toy vehicle storage case 10 is depicted in FIGS. 1-3.

A view of the disposition of raceway 20 when in transport configuration 22 is depicted in FIG. 4, where track segments 26 are arranged to produce a stack. The relatively compact nature of raceway 20 while in transport configuration 22 may allow raceway 20 to be enclosed within toy vehicle storage case 10, providing enhanced transportability.

Raceway 20 may be configured to transition between transport configuration 22 and racing configuration 24 by folding. For example, adjacent track segments 26 may be hingedly or pivotably coupled such that adjacent track segments 26 may pivot relative to each other. In some examples, adjacent track segments 26 may be coupled using external breakaway double hinges 76 on lateral sides of a track segment 26 as shown in FIGS. 4-6. Double hinges may include a joint having two pivoting connectors, one of which may be configured to break apart non-destructively if sufficient force is applied, such as when a child may inadvertently step on the joint.

In the example depicted in FIGS. 4-6, track segment 26*a* is hingedly connected to track segment 26*b*, which is hingedly connected to track segment 26*c*. A fourth track segment such as track segment 26*d* may be affixed to upper container portion 14. Additionally, track segments 26 may be of successively narrowing widths, and may include tabs 78 to allow a friction fit with other segments when in a folded position.

The projecting surface of one or more ribs 68 on a segment 26 may be configured to nest within a corresponding recess or slot 70 formed by corresponding ribs 68 on another segment 26 when in a folded position. For example, central ribs 68 on track segments 26*a* and 26*d* may form slot 70, and central rib 68 on track segment 26*b* may be configured to fit into this slot 70 when raceway 20 is in transport configuration 22. An example of a central slot 70 in track segments 26*a* and 26*d* is depicted in FIGS. 8A-9C. This arrangement may allow raceway 20 to be more compact when folded, because central ribs 68 of two track segments do not interfere with each other. In addition to facilitating a folding position, a wider version of ribs 68 may thus be formed on an earlier track segment such as track segment 26*a* and a narrower version of ribs 68 may be formed on a succeeding track segment such as track segment 26*b*, ensuring a toy vehicle encounters no major impediment as the toy vehicle travels down the resulting raceway in racing configuration 24.

One or more segments of raceway 20 may be operatively connected to toy vehicle storage case 10. For example, track segment 26*a* may be affixed to an inner surface of upper container portion 14 using screws, clips, adhesive, or any other suitable connection method. In other examples, track segment 26*a* may be hingedly attached to an inner surface of upper container portion 14 using a mounting hinge 80 as shown in FIG. 8B.

Figure 8A:
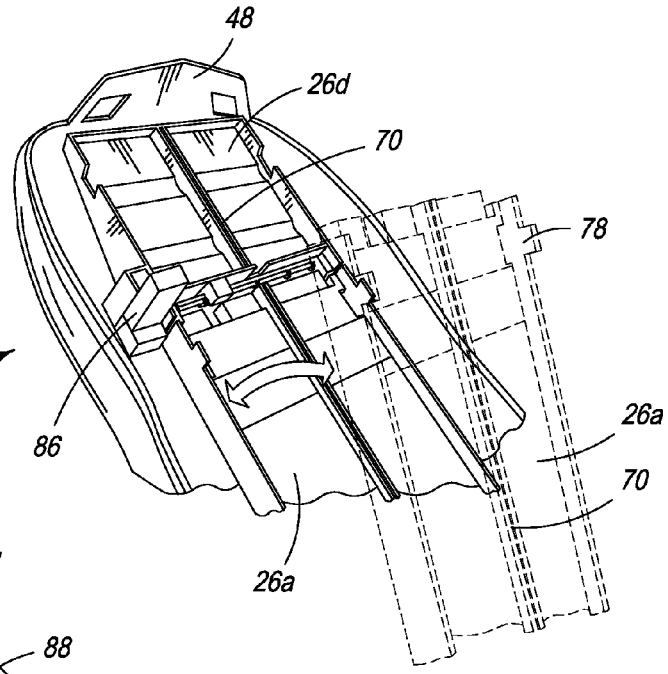
FIG. 8A is a perspective view of an illustrative track segment in a partially open position.
Figure 8B:
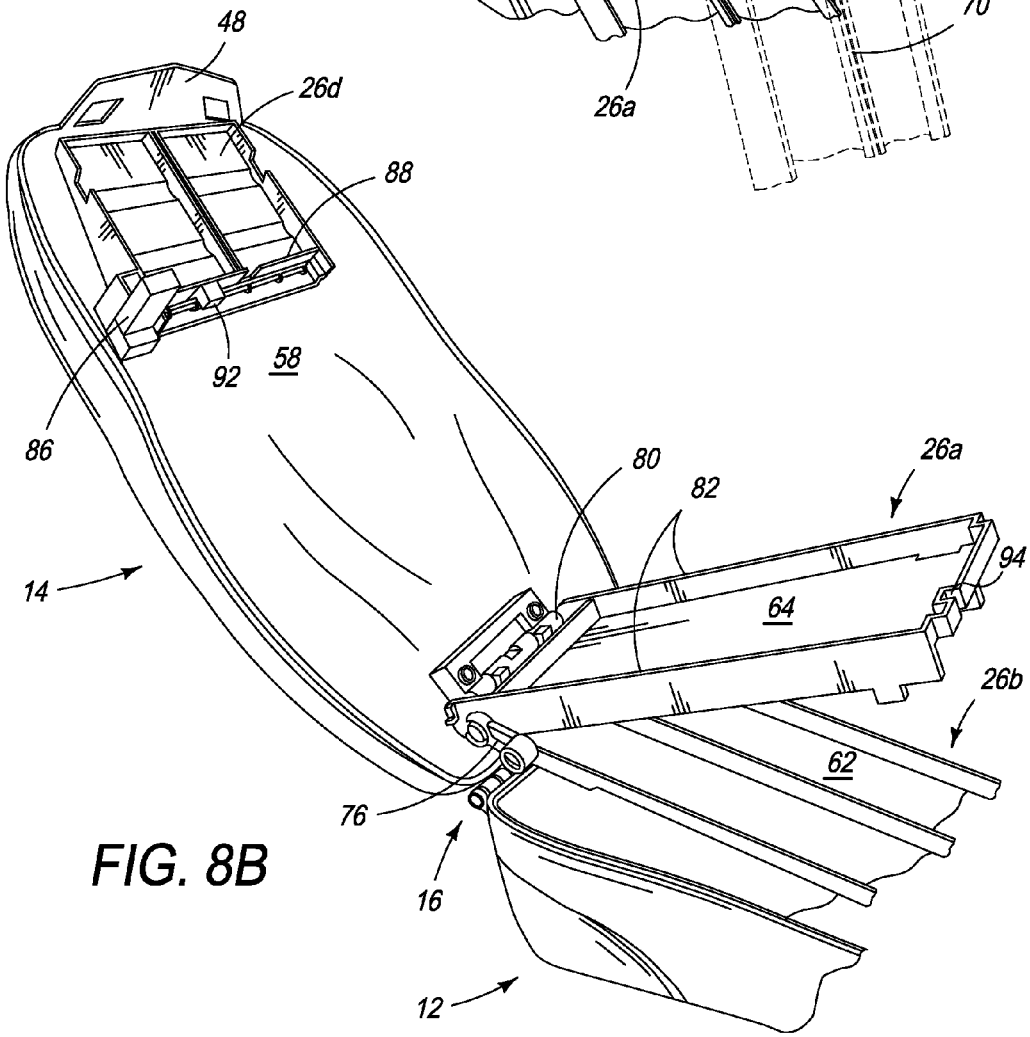
FIG. 8B is a perspective view of an illustrative track segment in a fully open position.
Figure 8C:
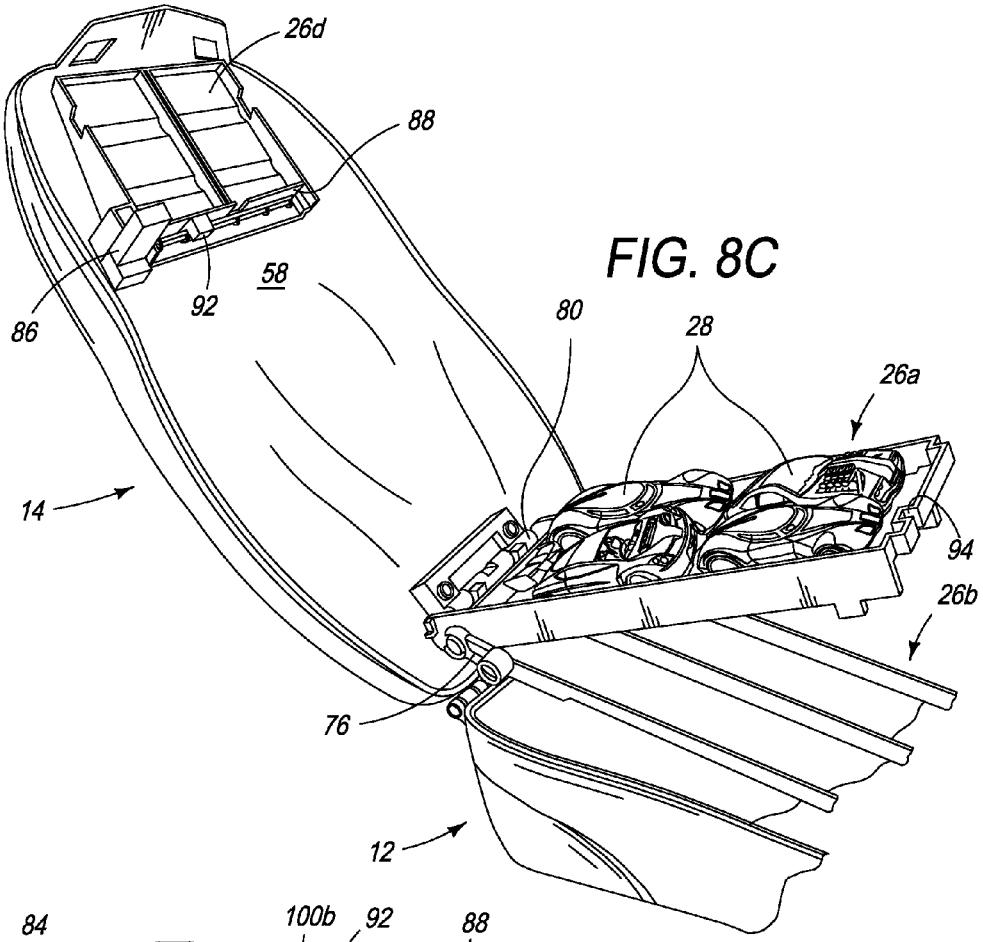
FIG. 8C is a perspective view of an illustrative track segment in a fully open position showing examples of toy racing vehicles.

FIGS. 8A-8C illustrate that attaching track segment 26*a* using mounting hinge 80 also facilitates pivoting track segment 26*a* away from upper container portion 14. This configuration allows selected covering and uncovering of storage space 58, where a user may store one or more toy vehicles 28. Accordingly, track segment 26*a* may be described as opened or closed relative to upper container portion 14. Alternatively, upper container portion 14 may be described as opened or closed relative to track segment 26*a* One or more retention walls 82 may be included on non-racing surface 64 of track segment 26*a* to facilitate retention of toy vehicles 28 and to form a walled storage compartment.

Figure 9A:
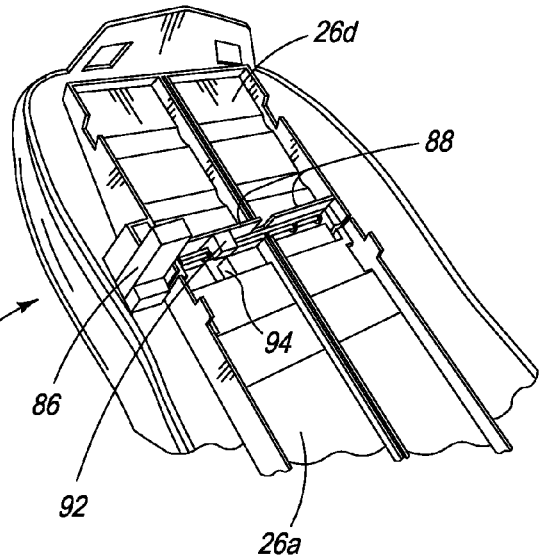
FIG. 9A is a perspective view of an illustrative starting gate assembly in a raised position.
Figure 9B:
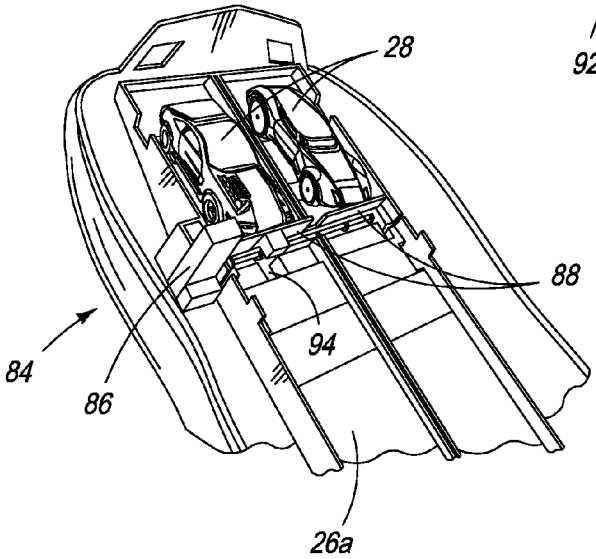
FIG. 9B is a perspective view of an illustrative starting gate assembly in a raised position showing examples of toy racing vehicles.
Figure 9C:
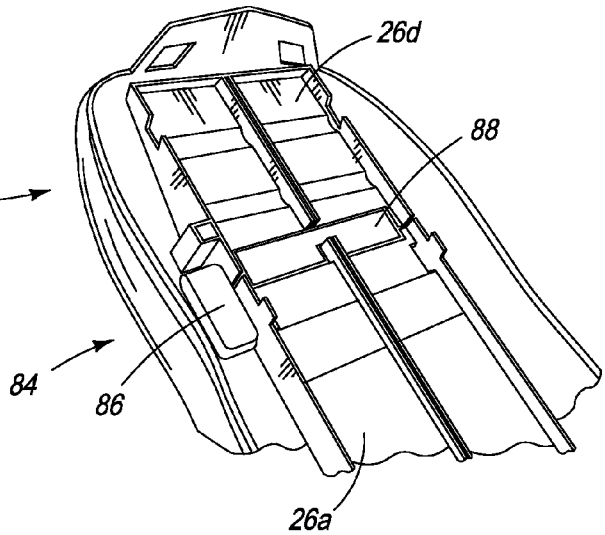
FIG. 9C is a perspective view of an illustrative starting gate assembly in a lowered position.

As shown in the example depicted in FIGS. 9A-9C, track segment 26*d* may also be attached to upper container portion 14, for example, using mounting screws or clips. Track segment 26*d* may be configured to provide a latching or friction fit with track segment 26*a*, such that track segment 26*a* is aligned and held in place when not pivoted away from upper container portion 14.

With continuing reference to FIGS. 9A-9C, track segment 26*d* may include starting gate assembly 84. Starting gate assembly 84 may include any suitable structure configured to selectively release one or more toy vehicles for travel along raceway 20 from first end 72 toward second end 74. For example, starting gate assembly 84 may include one or more retention/release members such as gate flaps 88, and an activation member such as pivoting actuator arm 86. Pivoting actuator arm 86 may be operatively connected to gate flaps 88 by axle 90.

Starting gate assembly 84 may be configured to selectively retain toy vehicles proximate the first end of raceway 20. Actuator arm 86 may be configured to move gate flaps 88 between a raised position with gate flaps 88 substantially orthogonal to track segment 26*d*, and a lowered position with gate flaps 88 substantially coplanar relative to track segment 26*d*. As illustrated in FIGS. 9A and 9B, gate flaps 88 may be configured as a plurality of tabs that project above the traveling surfaces of lanes 66 when raised, thus retaining toy vehicles 28. FIG. 9C illustrates that gate flaps 88 may become substantially coplanar with the travelling surfaces when pivoted into a lowered position by selectively urging actuator arm 86 toward the travelling surface, thereby releasing the toy vehicles.

In addition to releasing toy vehicles 28, starting gate assembly 84 may also be configured to function as a latching mechanism for retaining track segment 26*a*. Accordingly, starting gate assembly 84 may include latching member 92, which may be a block or projection formed or attached to a bottom surface of a gate flap 88 as shown in FIGS. 9A and 9B. Latching member 92 may fit into a corresponding recess 94 in an end of track segment 26*a*, providing positive lateral alignment. Latching may be further facilitated by lowering gate flaps into corresponding recesses in track segment 26*a*, selectively retaining and preventing track segment 26*a* from pivoting away from upper container portion 14.

Figure 10A:
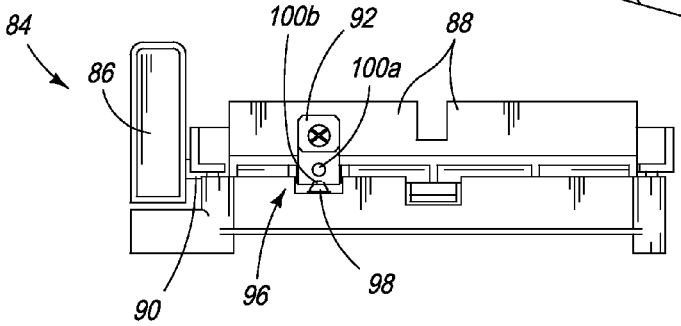
FIGS. 10A and 10B show a front detailed view of an illustrative starting gate assembly.
Figure 10B:
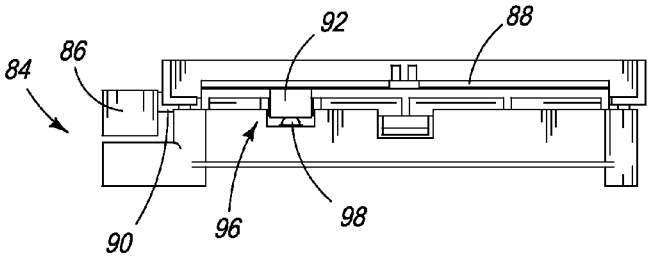

Referring to the more detailed illustrations of starting gate assembly 84 in FIGS. 10A and 10B, starting gate assembly 84 may further include detent 96 to facilitate positive positioning of gate flaps 88. Detent 96 may be any suitable mechanism configured to resist pivoting of actuator arm 86 and/or rotation of axle 90 when in certain positions. For example, detent 96 may include a spring-biased retention pin 98 and one or more corresponding dimples in latching member 92 such as dimples 100*a* and 100*b*. Detent 96 may be configured such that pin 98 is biased to engage one of the dimples when gate flaps 88 are in a raised or in a lowered position. Repositioning starting gate assembly 84 will require overcoming the resistance caused by a rounded portion of pin 98 being positively engaged in a dimple. Dimples 100*a* and 100*b* may be located on latching member 92 and disposed such that pin 98 may be positively engaged only when gate flaps 88 are fully lowered or fully raised.

From the above discussion and the drawings, various selected and additional embodiments may be described. One embodiment includes a storage case shaped like a vehicle with a multi-segment raceway and toy vehicle storage in the lower section. Another embodiment also includes further storage in the upper section of the case. In some examples, a starting gate assembly may be included in a pivoting first track segment, rather than in a separate fixed track segment. Another embodiment includes a completely detachable racetrack. Another embodiment includes a handle that provides stability to the deployed apparatus. Another embodiment includes a handle that props open the upper lid at a proper angle. Another embodiment includes a handle that extends lower than the plane of the floor of the lower container portion such that the storage case is held partially off of a support surface to alter the angle of the raceway or provide different support characteristics. Another embodiment includes various functional accessories attached to the vehicle-shaped case, such as mirrors or lights. Another embodiment includes other types of vehicle shapes storage case, such as a tow truck, where the handle may be shaped like a tow truck's boom or hook. Still other examples include rotatable wheels attached to the lower container portion.

The following reference numerals have been used in the drawings:

| | |
|---|---|
| 10 | Toy vehicle storage case |
| 12 | Lower container portion |
| 14 | Upper container portion |
| 16 | Hinge (of container) |
| 18 | Handle |
| 20 | Raceway |
| 22 | Transport configuration |
| 24 | Racing configuration |
| 26 | Track segments |
| 26a | First track segment |
| 26b | Second track segment |
| 26c | Third track segment |
| 26d | Fourth track segment |
| 28 | Toy vehicle |
| 30 | Floor of lower portion |
| 32 | Walls of lower portion |
| 34 | Perimeter of lower portion |
| 36 | Storage compartments |
| 38 | Support surface |
| 40 | Exterior of lower walls |
| 42 | Side walls |
| 44 | Front wall |
| 46 | Rear wall |
| 48 | Latch |
| 50 | Hinge knuckles |
| 52 | Hinge pins |
| 53 | Hinge of handle |
| 54 | Perimeter of upper portion |
| 56 | Canopy |
| 58 | Storage space |
| 60 | Upper hinge knuckles |

-continued

| | |
|---|---|
| 62 | Racing surface |
| 64 | Non-racing surface |
| 66 | Lanes |
| 68 | Ribs |
| 70 | Slot |
| 72 | First end of raceway |
| 74 | Second end of raceway |
| 76 | Double hinge |
| 78 | Tabs (on track) |
| 80 | Mounting Hinge |
| 82 | Side walls of track |
| 84 | Starting gate assembly |
| 86 | Pivoting actuator arm |
| 88 | Gate flaps |
| 90 | Axle |
| 92 | Latching member |
| 94 | Recess |
| 96 | Detent |
| 98 | Pin |
| 100a | First dimple |
| 100b | Second dimple |

What is claimed is:

1. A storage case comprising:

a first container portion including a first storage compartment and a mouth with a perimeter generally defining a first plane;

a second container portion including a second storage compartment and configured to mate with the first container portion, the second container portion having a mouth with a perimeter generally defining a second plane and a floor generally defining a third plane;

a raceway operatively connected to the first container portion, the raceway including a first track segment, and a second track segment, each track segment having a plurality of lanes;

wherein the container portions and raceway are capable of being arranged in a transport configuration and a racing configuration;

the transport configuration having the container portions closed with the first container portion and second container portion mated together and the track segments of the raceway arranged to fit within the mated container portions; and the racing configuration having the container portions open with the first plane positioned at an obtuse angle relative to the second plane, the track segments arranged to form a ramped raceway having the first track segment supported with one end elevated by the first container portion, the second track segment connected at one end to the first track segment; and wherein the first track segment is hingedly attached to the second track segment;

the first track segment includes a first and a second longitudinal rib forming a slot therebetween;

the second track segment includes a third longitudinal rib; and the third longitudinal rib is configured to fit into the slot.

2. The storage case of claim 1, further comprising a third track segment, wherein the third track segment has a first end connected to the second track segment.

3. The storage case of claim 1, further comprising a handle attached to the second container portion.

4. The storage case of claim 3, wherein the handle is capable of being placed in a plurality of positions, a first of the plurality of positions having a portion of the handle coplanar with the third plane.

5. The storage case of claim 4, wherein the handle is configured to have an appearance of a portion of a vehicle.

6. The storage case of claim 1, wherein the first container portion and the second container portion collectively form a vehicle-shaped container.

7. The storage case of claim 1, wherein the second storage compartment is sized and configured to allow storage of a plurality of toy vehicles.

8. The storage case of claim 2, further including a fourth track segment affixed to the first container portion and including a starting gate assembly having a pivoting actuator arm operatively connected to a gate flap;

wherein the actuator arm is configured to move the gate flap between a raised position with the gate flap substantially orthogonal to the fourth track segment and a lowered position with the gate flap substantially coplanar relative to the fourth track segment.

9. The storage case of claim 8, wherein the gate flap is configured to fit into a first recess formed in the first track segment when the gate flap is in the lowered position.

10. The storage case of claim 9, wherein the starting gate assembly further includes a latching member configured to retain the first track segment in substantial alignment with the fourth track segment by fitting into a second recess formed in the first track segment when the gate flap is in the lowered position.

11. The storage case of claim 10, the starting gate assembly further including a detent configured to resist repositioning of the gate flap when the gate flap is in either the raised position or the lowered position.

12. The storage case of claim 1, wherein the first container portion is hingedly attached to the second container portion.

13. The storage case of claim 8, wherein the raceway is connected to the first container portion by a hinge having one hinge portion affixed to the first container portion and a second hinge portion affixed to a first end of the first track segment; and the first track segment being placeable in a closed position and an open position;

the closed position having the first track segment covering the first storage compartment with a second end of the first track segment aligned with the fourth track segment, and the open position having the second end of the first track segment pivoted into a spaced apart relationship with the fourth track segment.

14. A storage case comprising:

a vehicle-shaped container having a plurality of storage compartments and a lid portion hingedly attached to a base portion such that the container is capable of being opened and closed;

a handle hingedly attached to the container, the handle configured to have the appearance of a portion of a vehicle;

a collapsible toy vehicle raceway operatively attached to the container;

the raceway including a racing surface on one side of the raceway and a non-racing surface on a reverse side of the raceway;

the raceway including a first track segment, and a second track segment, each track segment having a plurality of lanes defined on the racing surface;

the raceway configured to be contained by the container when the container is closed and supported in a ramped configuration by the container when the container is open;

wherein the handle is capable of being placed in a stabilizing position when the container is open; and wherein the first track segment is hingedly attached to the second track segment;

the first track segment includes a first and a second longitudinal rib forming a slot therebetween;

the second track segment includes a third longitudinal rib; and the third longitudinal rib is configured to fit into the slot.

15. The storage case of claim 14, wherein at least a portion of the non-racing surface includes a walled storage compartment.

16. The storage case of claim 14, wherein the non-racing surface of the raceway forms a cover for at least one of the plurality of storage compartments.

17. The storage case of claim 14, wherein the container is configured to have the appearance of a racing vehicle.

18. The storage case of claim 14, further including a latch formed as part of the lid portion.

19. The storage case of claim 14, wherein the base portion has a bottom surface, and the stabilizing position includes a portion of the handle being coplanar with the bottom surface of the base portion.

20. A storage case comprising:

a first container portion including a first storage compartment;

a second container portion including a second storage compartment and configured to mate with the first container portion;

a raceway operatively connected to the first container portion, the raceway including a first track segment with a first and a second longitudinal rib forming a slot therebetween, and a second track segment with a third longitudinal rib, each track segment having a plurality of lanes;

wherein the container and raceway are capable of being arranged in a transport configuration and a racing configuration, with the transport configuration having the container closed with the first container portion and second container portion mated together and the track segments of the raceway arranged to fit within the container; and with the racing configuration having the container open with the track segments arranged to form a ramped raceway; and wherein the third longitudinal rib is configured to fit into the slot when the container and raceway are arranged in the transport configuration.

21. The storage case of claim 20, wherein the first track segment is operatively connected to the first container portion using a first hinge near a first end of the first track segment and operatively connected to the second track segment using a second hinge near the first end of the first track segment.

22. The storage case of claim 21, further including a fourth track segment affixed to the first container portion, the fourth track segment having a starting gate assembly configured to selectively retain a second end of the first track segment.

23. A storage case comprising:

a first container portion including a first storage compartment and a mouth with a perimeter generally defining a first plane;

a second container portion including a second storage compartment and configured to mate with the first container portion, the second container portion having a mouth with a perimeter generally defining a second plane and a floor generally defining a third plane;

a raceway operatively connected to the first container portion, the raceway including a first track segment, a second track segment, a third track segment, and a fourth track segment; each track segment having a plurality of lanes;

wherein the container portions and raceway are capable of being arranged in a transport configuration and a racing configuration;

the transport configuration having the container portions closed with the first container portion and second container portion mated together and the track segments of the raceway arranged to fit within the mated container portions; and the racing configuration having the container portions open with the first plane positioned at an obtuse angle relative to the second plane, the track segments arranged to form a ramped raceway having the first track segment supported with one end elevated by the first container portion, the second track segment connected at one end to the first track segment; and wherein the third track segment has a first end connected to the second track segment;

wherein the fourth track segment is affixed to the first container portion and includes a starting gate assembly having a pivoting actuator arm operatively connected to a gate flap, and the actuator arm is configured to move the gate flap between a raised position with the gate flap substantially orthogonal to the fourth track segment and a lowered position with the gate flap substantially coplanar relative to the fourth track segment.

24. The storage case of claim 23, wherein the gate flap is configured to fit into a first recess formed in the first track segment when the gate flap is in the lowered position.

25. The storage case of claim 24, wherein the starting gate assembly further includes a latching member configured to retain the first track segment in substantial alignment with the fourth track segment by fitting into a second recess formed in the first track segment when the gate flap is in the lowered position.

26. The storage case of claim 23, wherein the first track segment is hingedly attached to the second track segment and the second track segment is hingedly attached to the third track segment.

27. The storage case of claim 23, wherein the raceway is connected to the first container portion by a hinge having one hinge portion affixed to the first container portion and a second hinge portion affixed to a first end of the first track segment; and the first track segment being placeable in a closed position and an open position;

the closed position having the first track segment covering the first storage compartment with a second end of the first track segment aligned with the fourth track segment, and the open position having the second end of the first track segment pivoted into a spaced apart relationship with the fourth track segment.

28. A storage case comprising:

a vehicle-shaped container having a plurality of storage compartments and a lid portion hingedly attached to a base portion such that the container is capable of being opened and closed;

a handle hingedly attached to the container, the handle configured to have the appearance of a portion of a vehicle;

a collapsible toy vehicle raceway operatively attached to the container;

the raceway including a racing surface on one side of the raceway and a non-racing surface on a reverse side of the raceway;

the raceway including and a starting track segment, a first track segment, and a second track segment, each track segment having a plurality of lanes defined on the racing surface;

the raceway configured to be contained by the container when the container is closed and supported in a ramped configuration by the container when the container is open;

wherein the handle is capable of being placed in a stabilizing position when the container is open; and wherein the starting track segment is affixed to the first container portion and includes a starting gate assembly having a pivoting actuator arm operatively connected to a gate flap;

the actuator arm is configured to move the gate flap between a raised position with the gate flap substantially orthogonal to the fourth track segment and a lowered position with the gate flap substantially coplanar relative to the fourth track segment; and the starting gate assembly further includes a latching member configured to retain the first track segment in substantial alignment with the fourth track segment by fitting into a second recess formed in the first track segment when the gate flap is in the lowered position.

29. The storage case of claim 28, wherein the gate flap is configured to fit into a first recess formed in the first track segment when the gate flap is in the lowered position.

30. The storage case of claim 28, the starting gate assembly further including a detent configured to resist repositioning of the gate flap when the gate flap is in either the raised position or the lowered position.

31. The storage case of claim 28, wherein the raceway includes a plurality of hinged segments.

* * * * *